US007789533B2

(12) United States Patent
Von Preyss

(10) Patent No.: US 7,789,533 B2
(45) Date of Patent: Sep. 7, 2010

(54) LAMP SUPPORT LINEARLY AND ANGUARLY ADJUSTABLE ABOUT ORTHOHONAL DIRECTIONS

(75) Inventor: Thomas Aleksander Henrik Von Preyss, Lystrup (DK)

(73) Assignee: Martin Professional A/S, Aarhus N (DK)

( * ) Notice: Subject to any disclaimer, the term of this patent is extended or adjusted under 35 U.S.C. 154(b) by 194 days.

(21) Appl. No.: 12/107,837

(22) Filed: Apr. 23, 2008

(65) Prior Publication Data

US 2009/0268467 A1 Oct. 29, 2009

(51) Int. Cl.
*F21V 19/00* (2006.01)
*F21V 21/29* (2006.01)

(52) U.S. Cl. ..... 362/289; 362/273; 362/428; 362/429; 362/430; 362/249.09

(58) Field of Classification Search ..... 362/249.1, 362/249.09, 269, 273, 285, 287, 289, 418, 362/419, 426, 427, 428, 429, 430, 366, 372
See application file for complete search history.

(56) References Cited

U.S. PATENT DOCUMENTS

| | | | | | |
|---|---|---|---|---|---|
| 1,606,183 | A | * | 11/1926 | Rolfes | 362/289 |
| 3,251,986 | A | * | 5/1966 | Collier | 362/287 |
| 3,299,263 | A | * | 1/1967 | Bjontegard | 362/220 |
| 3,348,035 | A | * | 10/1967 | Baldwin et al. | 362/285 |
| 3,590,238 | A | * | 6/1971 | Arens | 362/285 |
| 3,705,301 | A | * | 12/1972 | Franklin et al. | 362/308 |
| 4,061,912 | A | | 12/1977 | Levasseur | |
| 4,173,037 | A | * | 10/1979 | Henderson et al. | 362/287 |
| 4,319,313 | A | * | 3/1982 | Eberhart et al. | 362/370 |
| 4,527,224 | A | * | 7/1985 | Sangiamo et al. | 362/282 |
| 5,722,770 | A | * | 3/1998 | Douglas | 362/285 |
| 6,932,491 | B2 | | 8/2005 | Esakoff | |
| 7,264,372 | B2 | | 9/2007 | Maglica | |
| 2007/0025111 | A1 | * | 2/2007 | Jacklin et al. | 362/429 |
| 2007/0268705 | A1 | * | 11/2007 | Von Preyss | 362/306 |

FOREIGN PATENT DOCUMENTS

| | | | |
|---|---|---|---|
| DE | 38 07 504 | A1 | 9/1989 |
| EP | 0 989 360 | A2 | 3/2000 |
| WO | 97/12176 | A1 | 4/1997 |
| WO | 2007/006578 | A1 | 1/2007 |
| WO | 2007/012173 | A1 | 2/2007 |

* cited by examiner

*Primary Examiner*—Ismael Negron
(74) *Attorney, Agent, or Firm*—Roberts Mlotkowski Safran & Cole, P.C.; David S. Safran

(57) ABSTRACT

A light fixture comprising a lamp assembly including a socket and a light source extending along a light fixture axial direction from one side of the socket. The light source is placed in a reflector such that light emitted by the light source is reflected by the reflector in the axial direction. The socket is supported by an inner ring which is supported by a middle ring and the middle ring is supporting by an outer ring. The inner ring is tiltable about a first axis that is orthogonal to the axial direction for tilting the light source, the middle ring is tiltable about a second axis that is orthogonal to both the axial direction and the first axis for tilting the inner ring, and the middle ring being movable with respect to the outer ring in the axial direction.

9 Claims, 7 Drawing Sheets

LAMP SUPPORT LINEARLY AND ANGUARLY ADJUSTABLE ABOUT ORTHOHONAL DIRECTIONS

BACKGROUND OF THE INVENTION

1. Field of the Invention

The present invention relates to a light fixture comprising a housing, which housing comprise a lamp assembly, which lamp assembly comprises a socket, from which socket a light source extending axially from one side of the socket, which light source is placed in a reflector, from which reflector generated light is reflected to light forming means, which socket is connected to adjusting means for changing the placement of the light source in relation to the reflector.

The present invention further relates to a method for lamp adjustment in a light fixture, where a lamp socket from the backside of a reflector is adjustable by screwing means in one or more directions.

2. Description of Related Art

WO 2007/006578 discloses projector housing for a burner or a lamp comprising a glass receptacle, a lamp base, contact pins for supplying power, and a lamp holder with socket contacts. The projector housing encompasses a receiving device with clamping jaws which can be non-positively and/or positively connected to the lamp base, embrace the lamp base, and are hinged to the lamp housing via lever arms. The clamping jaws are adjustable with the aid of an adjusting mechanism. The adjusting mechanism is provided with an adjusting member (5) that is disposed between the lever arms, presses the lever arms apart in order to open the clamping jaws into an open position in which the lamp base is released, and unites the lever arms so as to close the clamping jaws in a locked position in which the lamp base is fixed. The adjusting member can be rotated about an adjusting shaft while resting against the lever arms by means of parts that are placed at a different distance from the adjusting shaft and are diametrically opposed in relation to the adjusting shaft.

WO 2007/012173 discloses a mounting assembly for a lamp socket that is adjustable, comprises a bracket configured to be mechanically coupled to a luminaire assembly and a mounting plate configured to attach to the lamp socket and be mechanically coupled to the bracket and selectively engages the bracket at one of a multiplicity of angular rotations. A corresponding method of aligning a lamp to a desired rotational position with respect to a luminaire, includes disengaging a mounting plate from a bracket, where the mounting plate and the bracket are coupled about a common axis of rotation, rotating the mounting plate about the axis to a rotational position corresponding to the desired rotational position of the lamp and re-engaging the mounting plate and the bracket.

U.S. Pat. No. 6,932,491 concerns a theatrical luminaire for entertainment and architectural applications includes a lamp socket accessible from the exterior of the luminaire housing. A lamp includes a base, a bulb on one side of the base and a handle on the other side. The handle is grasped to insert the lamp into the socket. When the base is mounted in the socket, the bulb extends through the socket into the luminaire and the handle remains accessible at the exterior of the luminaire. The lamp is mounted with a one-handed push and turn motion, and contacts on wings of the base engage socket contacts as the lamp is turned to its final position. The socket is mounted on a support that is adjustable relative to the luminaire housing to preserve the correct lamp positioning when the lamp is replaced.

SUMMARY OF THE INVENTION

It is an object of this invention to perform effective independent adjustment of a light source in relation to a reflector.

The object can be achieved if a light source can be adjusted as described herein. That is, the adjustment mean are formed as a first inner ring, to which inner ring the socket is fastened, which inner ring is moveable in a first direction for tilting the light source, which first inner ring is movable in relation to a second middle ring, which middle ring is moveable in a second direction which is orthogonal to the first direction for tilting the first inner ring, which second ring is movable in relation to a third outer ring in a third direction which is orthogonal to the first and second directions.

By mechanically splitting the adjustment process so that different mechanical components are adjusted independently, adjustment one adjustment screw has only influence on the light source in one direction, and there is no influence in any of the other directions. In this way, a much more precise and highly efficient adjustment of a light source can be achieved.

In a preferred embodiment of the invention the second middle ring can comprise at least one protrusion, which protrusion is placed in a slant track in the third outer ring, where rotation of the third outer ring in relation to the protrusion result in movement in the third direction of the second middle ring. Hereby, a highly efficient linear translation in the third direction can be achieved. In practice, this will mean in and out of a reflector. The translation is performed just by rotating that outer ring, which comprises the middle ring and the inner ring connected to the lamp socket will be moved in the third direction by rotating the ring.

The third outer ring can be rotated in relation to at least one frame, which frame can be fixed to the light fixture. The outer ring is rotatably fastened to the frame so that the inner ring, as the two further rings inside that ring, has freedom to be moved in three different directions. By fixing the frame to the housing of the light fixture where probably also a parabolic reflector is fixed, movement of the lamp socket and the light source will then be relative to the reflector.

The frame might comprises a first and a second plate, between these plates the third ring can be rotating, which first and second plate of the frame is interconnected by spacers for holding the third rotating ring in place. One possible way of achieving a rotation of the third outer ring is of course to place this rotating ring between an upper and a lower plate which plates form housing for the rotating ring. One way of forming such housing is of course using an upper and a lower plate and interconnecting these plates by spacers. An alternative embodiment of the invention, the frame comprising an upper plate and a lower plate, could be formed as a moulded component where part of the moulding is forming the spacing elements.

A first number of spacers can be interconnecting the first and the second plates of the frame, which first number of spacers can comprise rollers, which rollers are in rotating contact with the third outer ring. By double using the spacers using them for axles for rollers, the spacers have a double function. If at least three rollers are placed around the rotating outer ring, they can rotate and press the ring into correct position from at least three different directions. Hereby, the rotating outer ring automatically been kept in correct place.

A second number of spacers can be interconnecting the first and the second plates of the frame, which second number of spacers, can comprise protrusion members, which protrusion members are interfering with slant track in the third outer ring, which second number of spacers comprises springs, which springs presses the protrusion members into contact with the slant track in the third ring. By letting the protrusions press down the rotating outer ring this ring is kept in place also in the longitudinal Z direction.

The third outer ring comprises at least at toothed section, which toothed section is cooperating with a tooted wheel, which toothed wheel is rotatable fastened to the frame, which toothed wheel is connected to a screw. One way of rotating the outer ring is to let the outer ring at some of the circumference inside or outside comprise tooths that can cooperate with a toothed wheel. By rotating the toothed wheel e.g. by a hand tool it is possible to change the position of a light source.

The object can also be achieved by a method of the invention if the lamp socket is adjustable in three directions by independent adjusting means, where a first adjustment in a first direction is performed by tilting the first inner ring by first screwing means, where a second adjustment in a second direction is performed by tilting a second middle ring by second screwing means, and where a third adjustment is performed by a linear translation of a third outer ring by third screwing means in relation to a surrounding frame.

Hereby, it can be achieved that a light source can be adjusted independently in the three different directions with three different adjustment means. These will lead to a highly efficient adjustment of a light fixture each time a light source has been changed or if the light fixture has been handled roughly during transportation so that new adjustment is necessary.

The translation of the third outer ring can be performed by rotation of the third outer ring in relation to the frame. One way of performing the linear translation will be rotating the third outer ring maybe by means of tools from the outside. Hereby, the translation is performed in or out of a reflector.

DETAILED DESCRIPTION OF THE INVENTION

Figure 1:
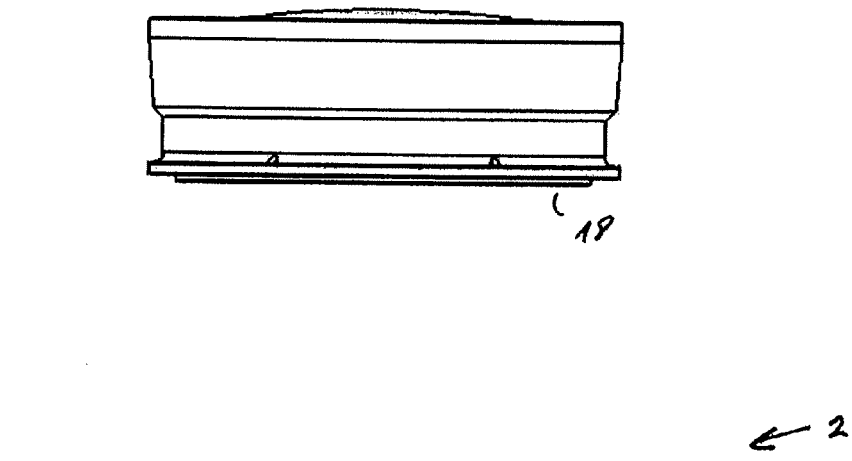
FIG. 1 shows different components in relation to a light fixture.

FIG. 1 shows different components in relation to a light fixture 2 where 4 indicates a light source fixture according to this invention, where a light source not shown is placed inside a reflector 6. This reflector reflects light which is modified in light forming means 8, 10 and 12 are modified. A first lens group 16 is held in a fixture 14, and a further lens group 18.

Figure 2:
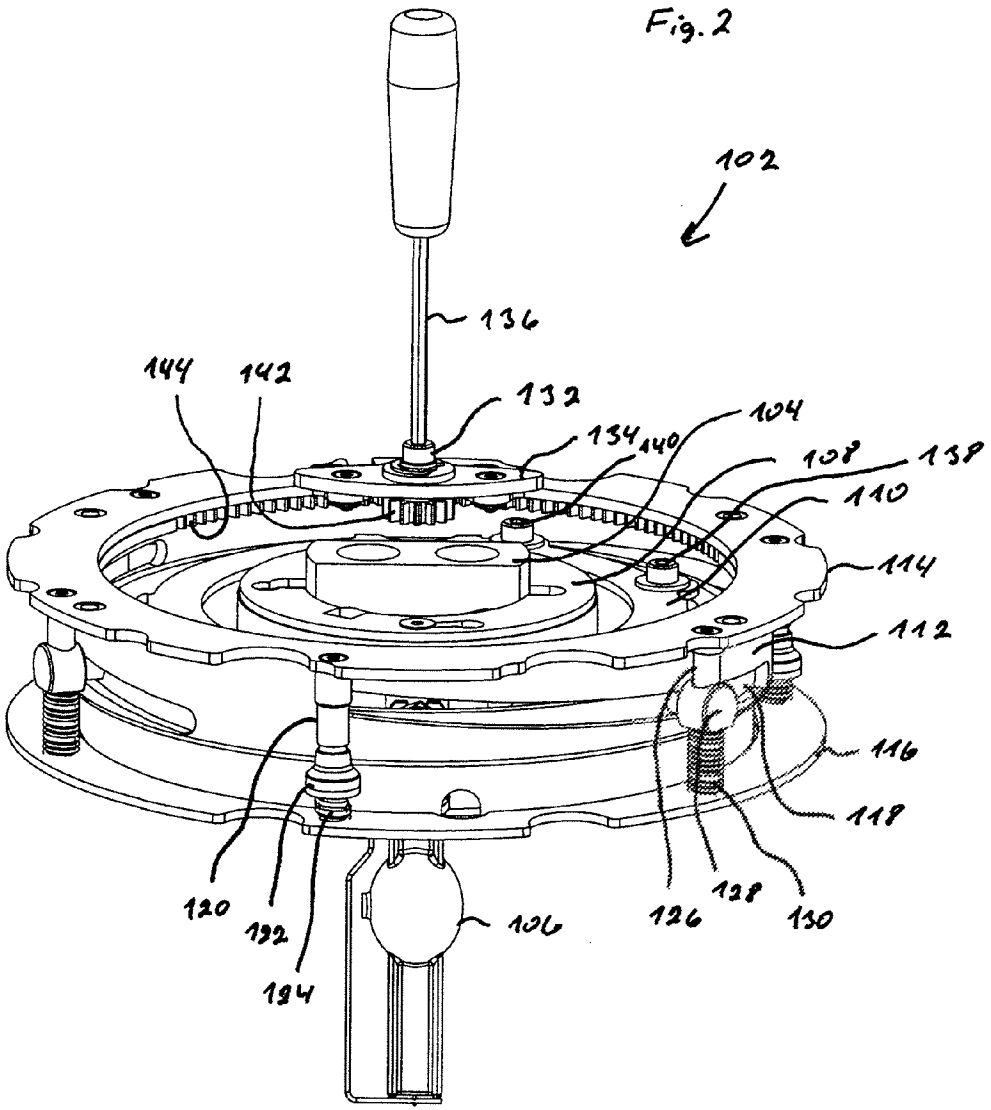
FIG. 2 shows a lamp assembly.

FIG. 2 shows a lamp assembly 102 which comprises a lamp socket 104 which is holding a light source 106. The lamp socket 104 is placed in a inner ring 108. The inner ring 108 is further placed inside a middle ring 110. This middle ring 110 is placed inside an outer ring 112. This outer ring 112 is placed between a first plate 114 and a second plate 116. The outer ring 112 comprises a slant track 118. A first number of spacers 120 are connecting the upper plate 114 and the lower plate 116. The spacer 120 comprises a roller 122 which roller is under pressure of a spring 124. Further spacers 126 also interconnecting the plate 114 and the plate 116. The spacer 126 comprises a slideable protrusion device 128 and a spring 130. A first adjustment screw 132 is rotatable in a fixture 134 where rotation can be performed by a hand tool 136. Adjustment of the inner ring 108 is performed by screwing means 138 and adjustment of the middle ring in a perpendicular direction is performed by the screw 140. A toothed wheel 142 is directly connected to the screw 132. This toothed wheel 142 is cooperating with the toothed inner part 144 of the third outer rotating ring 112.

In operation, the adjustment in the directions upwards or downwards according to this FIG. 2 is performed by rotating the toothed wheel 142 by the hand tool 136. This will lead to movement of the lamp socket 104, the inner ring 108, the middle ring 110 in relation to the outer plates 114 and 116 which will be fastened to the light fixture housing. Therefore, the light source 106 will be moved in relation to a reflector. Hereby, the point where light is generated will be adjustable in the longitudinal direction along the axis of the light. By adjusting the placement of the light source, the focal point can be more precisely defined.

Figure 3:
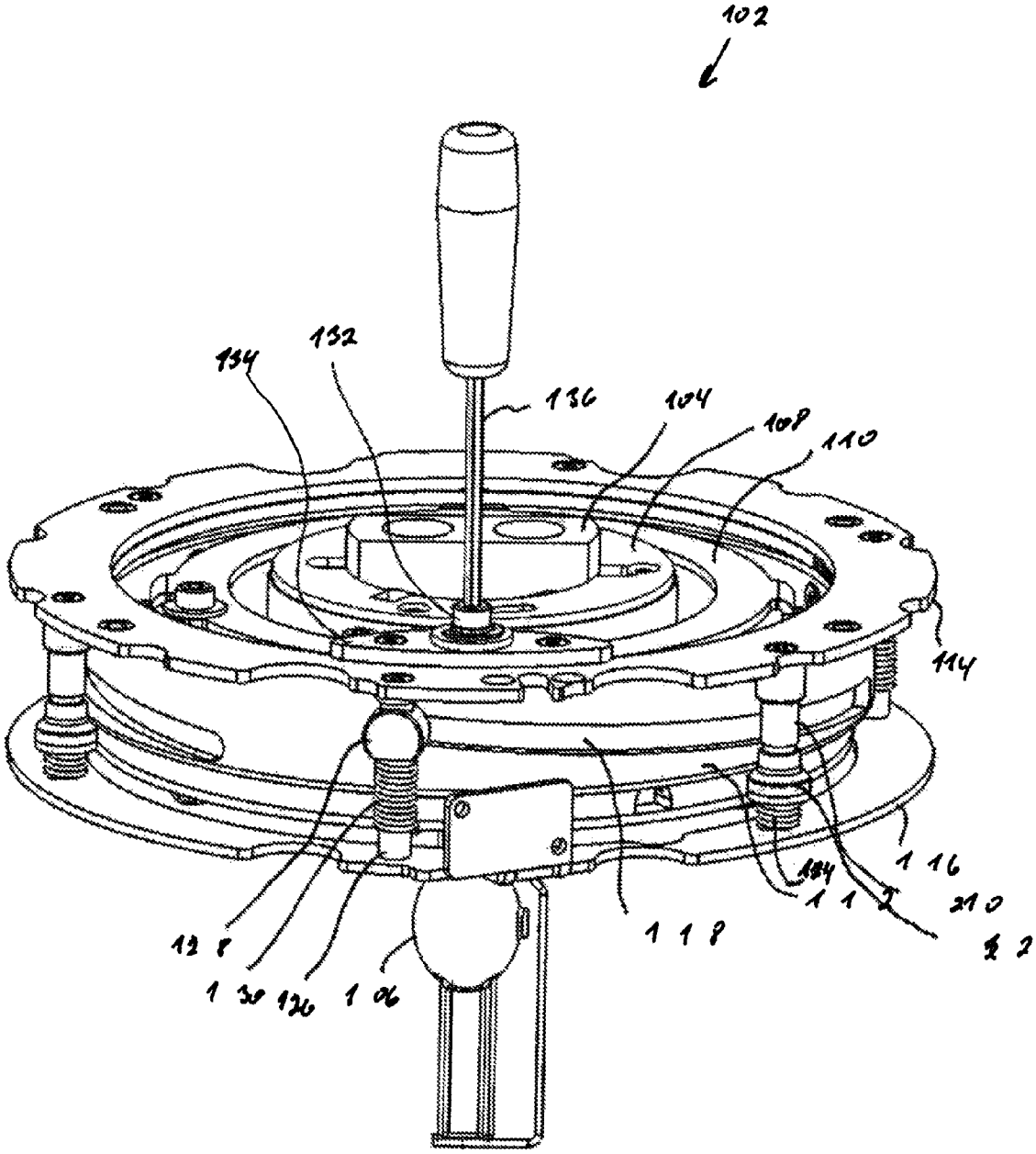
FIG. 3 shows the same embodiment as FIG. 2, but in another mode of operation.

FIG. 3 shows the same embodiment as FIG. 2, and the single components are not further mentioned. In FIG. 3, the figure has been turned so that the hand tool 136 is now at the viewing side of the picture, and the light source 106 is now moved into an upper position in relation to the axis of the figure. It is seen here that the lamp socket 104 is placed somewhat higher as shown in FIG. 2. It is also indicated that the light source 106 is now placed relatively higher that in FIG. 2.

Figure 4:
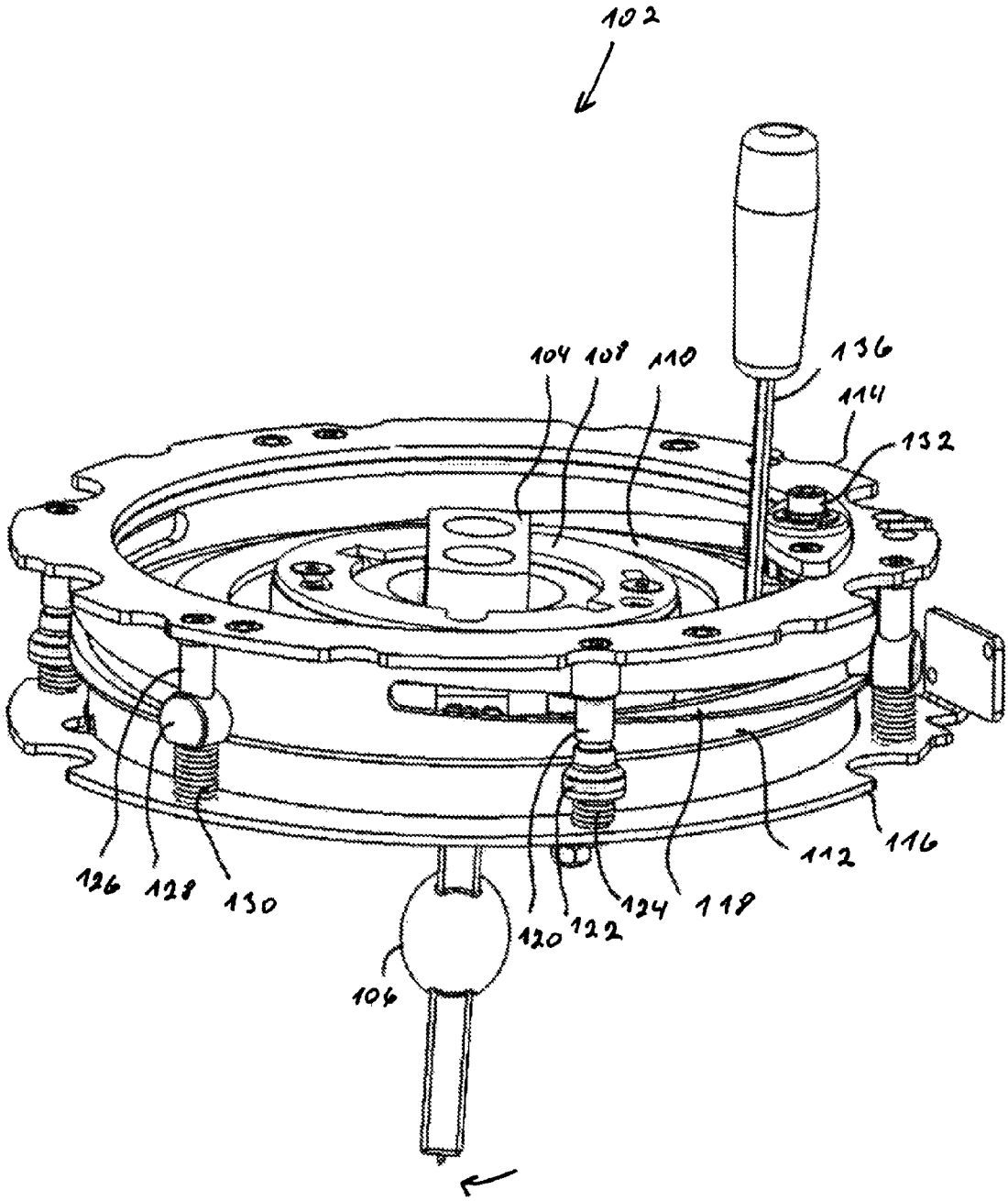
FIG. 4 shows the same embodiment as FIG. 3, but in another mode of operation.

FIG. 4 shows the same embodiment 102 of the invention, but in this figure, the hand tool 136 is moved into one of the two tilting positions, in the illustrated position, the middle ring 110 has been tilted so as to move the light source 106 slightly in the direction of the arrow shown in the figure.

Figure 5:
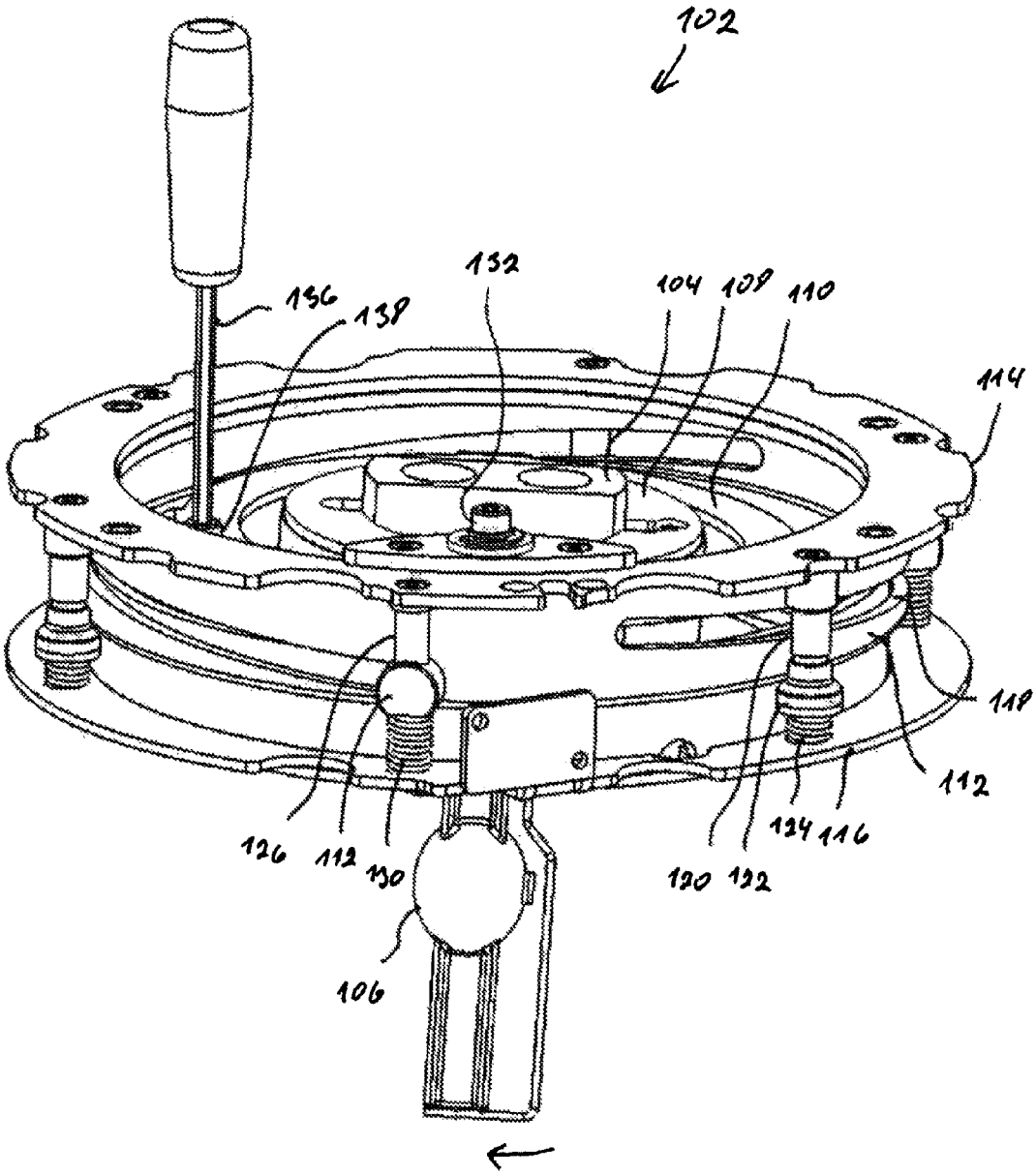
FIG. 5 shows the same embodiment as FIG. 4, but in another mode of operation.

FIG. 5 shows the same embodiment 102 but seen from another direction where the adjustment screw 138 is seen which is now connected to the hand tool 136. In the situation shown in FIG. 5, the light source 106 is tilted again but this time in a perpendicular direction as seen in FIG. 4. In this situation, the inner ring 108 is being tilted and hereby the lamp socket 104 is also tilted. This tilting will result in a sideways movement of the light source 106.

Figure 6:
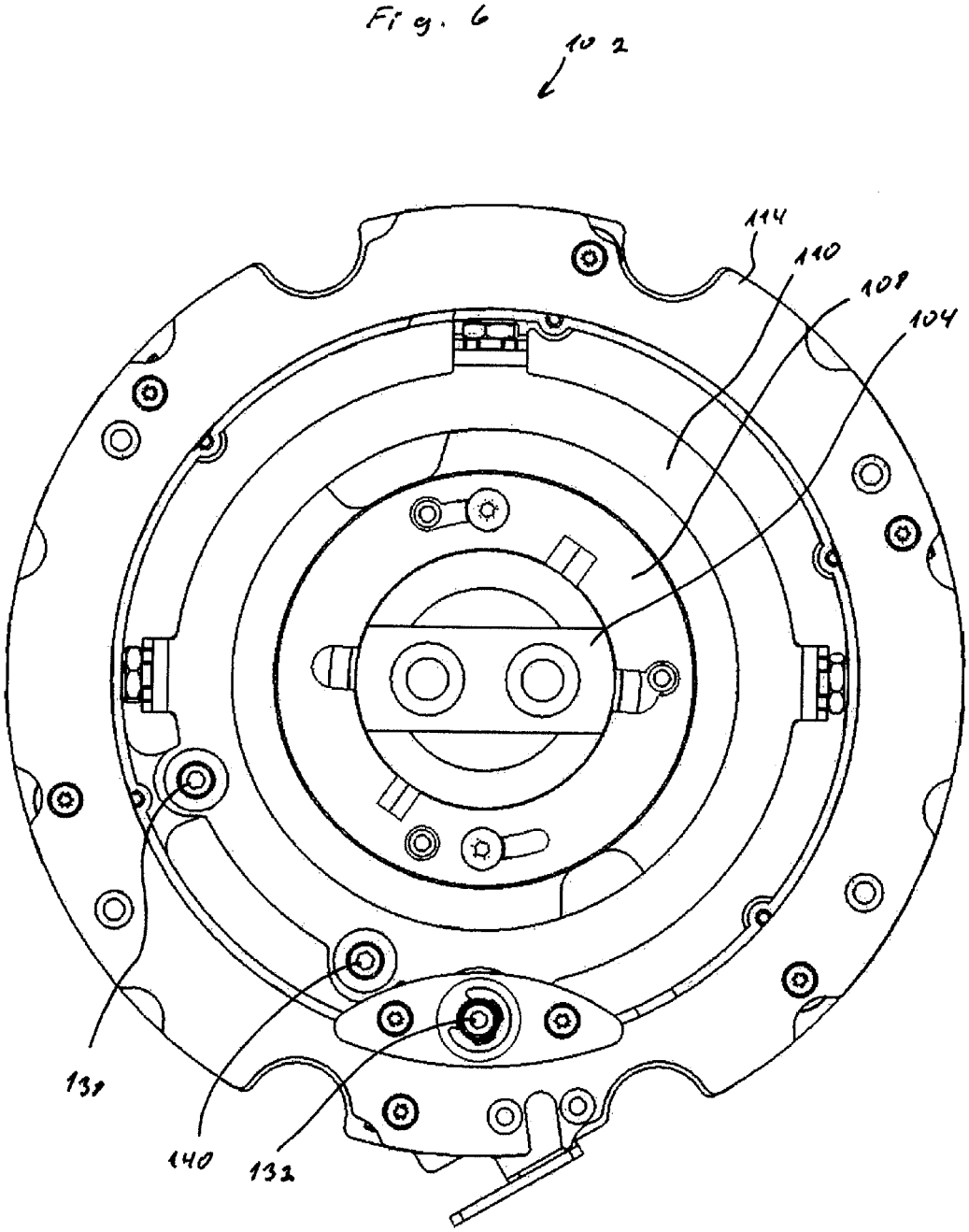
FIG. 6 shows the lamp assembly seen from the back.

FIG. 6 shows the lamp assembly 102 seen from the back. In this figure, the lamp socket 104, the inner ring 106, the middle ring 110 and the outer ring hidden below the plate 114 are indicated. Furthermore, the adjustment screws 132 for the longitudinal direction, the adjustment screw 138 for tilting around the first axis and adjustment screw 140 for tilting around the second axis are indicated.

Figure 7:
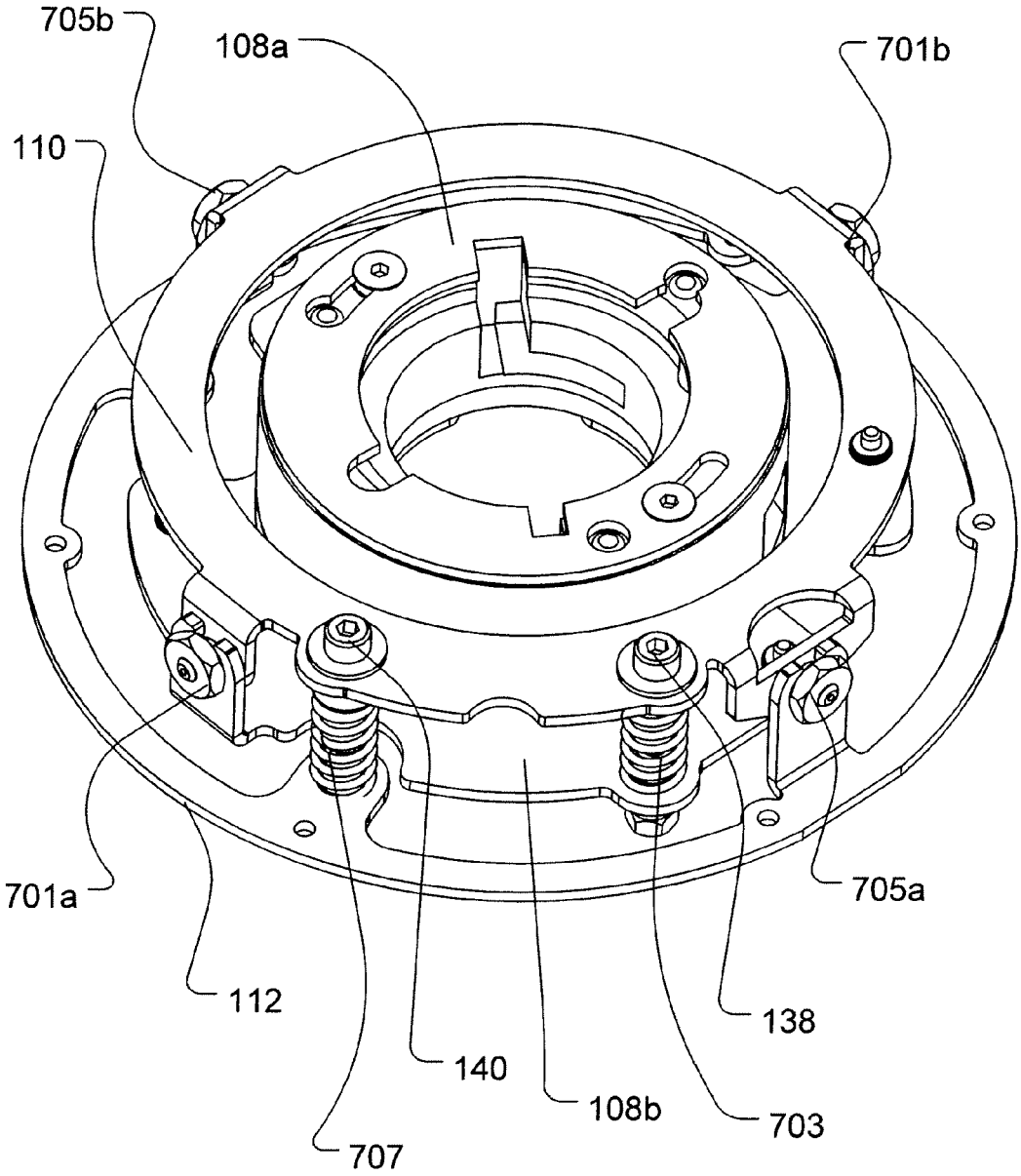
FIG. 7 shows a perspective view of the lamp assembly.

FIG. 7 shows a perspective view of the lamp assembly where the socket 104, the first plate 114, the second plate 116 and the part of the outer ring 112 comprising the slant track 118 have been removed. The inner ring 108 has an upper part **108*a* where the socket can be secured and a lower part 108*b* pivotally connected to the middle ring 110 at two pivoted points 701*a* and 701*b*. The screwing means 138 interconnects the middle ring 110 and the lower part 108*b* of the inner ring and will, when tightened, pull the lower part 108*b* of the inner ring towards the middle ring 110 causing the inner ring 108 to tilt around the pivot points 701*a* and 701*b*. The screwing means 138 also comprises a tensioning spring 703 that applies tension between the inner ring 108 and the middle ring 110**.

The middle ring 110 is pivotally connected to the outer ring 112 at the pivot points **705*a* and 705*b*. The screwing means 140 interconnects the middle ring 110 and the outer ring and will, when tightened, pull middle ring 110 towards the outer ring causing the middle ring 110** to tilt around pivot points

705*a* and 705*b*. The screwing means 140 comprises also a tensioning spring 707 applying between the middle ring 110 and the outer ring 112.

What is claimed is:

1. A light fixture comprising:

a lamp assembly including a socket and a light source extending along a light fixture axial direction from one side of the socket;

a reflector, the light source being located in the reflector such that light emitted by the light source is reflected by the reflector in the axial direction;

adjusting means for changing the location of the light source in relation to the reflector, said adjustment means being connected to the socket and including an inner ring directly supporting the socket, a middle ring supporting the inner ring, and an outer ring supporting the middle ring;

a housing to which the lamp assembly, reflector and the adjustment means are afixed;

wherein the inner ring is tiltable about a first axis that is orthogonal to the axial direction for tilting the light source, the middle ring is tiltable about a second axis that is orthogonal to both the axial direction and the first axis for tilting the inner ring, and the middle ring is movable with respect to the outer ring in the axial direction.

2. A light fixture according to claim 1, wherein the middle ring comprises at least one protrusion, which protrusion is placed in a slant track in the outer ring, where rotation of the outer ring in relation to the protrusion result in movement of the middle ring with respect to the outer ring in an axial direction.

3. A light fixture according to claim 2, wherein the outer ring is rotated in relation to at least one frame, which frame is fixed to the light fixture.

4. A light fixture according to claim 3, wherein the frame comprises a first and a second plate, between these plates the outer ring is rotating, which first and second plate of the frame is interconnected by spacers for holding the third rotating ring in place.

5. A light fixture according to claim 4, wherein a first number of spacers are interconnecting the first and the second plates of the frame, which first number of spacers comprises rollers, which rollers are in rotating contact with the outer ring.

6. A light fixture according to claim 4, wherein a second number of spacers are interconnecting the first and the second plates of the frame, which second number of spacers, comprises protrusion members, which protrusion members are interfering with slant track in the third outer ring, which second number of spacers comprises springs, which springs presses the protrusion members into contact with the slant track in the outer ring.

7. A light fixture according to claim 4, wherein the outer ring comprises at least at toothed section, which toothed section is cooperating with a toothed wheel, which toothed wheel is rota table fastened to the frame, which toothed wheel is connected to a screw.

8. A method for lamp adjustment in a light fixture comprising the steps of:

providing a lamp assembly including a socket and a light source extending along a light fixture axial direction from one side of the socket; and providing a reflector, the light source being placed in the reflector such that light emitted by the light emitted by the light source is reflected by the reflector in the axial direction; and adjusting the socket from the backside of a reflector by screwing means in at least one three available adjustment directions by respective independent adjusting means, a first adjustment being performable by tilting an inner ring about a first axis that is orthogonal to the axial direction for tilting the light source by a first screwing means, the inner ring directly supporting the socket, a second adjustment being performable by tilting a middle ring about a second axis that is orthogonal to both the axial direction and the first axis for tilting the inner ring by a second screwing means, and a third adjustment being performable by moving the middle ring with respect to the outer ring in the axial direction.

9. A method according to claim 8, wherein the translation of the third outer ring is performed by rotation of the third outer ring in relation to the frame.

* * * * *